US008950014B2

(12) United States Patent
Schottenstein

(10) Patent No.: US 8,950,014 B2
(45) Date of Patent: Feb. 10, 2015

(54) EXTENDABLE COLLAR STAY

(75) Inventor: David B. Schottenstein, Columbus, OH (US)

(73) Assignee: Extendable Collar Stay Co. LLC, Surfside, FL (US)

( * ) Notice: Subject to any disclaimer, the term of this patent is extended or adjusted under 35 U.S.C. 154(b) by 0 days.

(21) Appl. No.: 13/416,737

(22) Filed: Mar. 9, 2012

(65) Prior Publication Data

US 2012/0227163 A1 Sep. 13, 2012

Related U.S. Application Data

(60) Provisional application No. 61/451,112, filed on Mar. 9, 2011.

(51) Int. Cl.

| | |
|---|---|
| ***A41B 3/00*** | (2006.01) |
| ***A41C 1/14*** | (2006.01) |
| ***A41D 27/00*** | (2006.01) |
| ***A41D 27/06*** | (2006.01) |
| ***A41B 3/06*** | (2006.01) |

(52) U.S. Cl.
CPC ..... *A41B 3/06* (2013.01)
USPC ..... 2/132; 2/255

(58) Field of Classification Search
USPC ..... 2/60, 255, 256; 283/56
See application file for complete search history.

(56) References Cited

U.S. PATENT DOCUMENTS

| | | | | |
|---|---|---|---|---|
| 752,297 | A * | 2/1904 | Parker | 2/256 |
| 811,326 | A | 1/1906 | Reynolds | |
| 821,678 | A | 5/1906 | Theberath | |
| 858,319 | A * | 6/1907 | Adams | 450/145 |
| 950,073 | A | 2/1910 | Marinsky | |
| 991,402 | A | 5/1911 | Windrich | |
| 1,013,783 | A | 1/1912 | Krischer | |
| 2,004,288 | A * | 6/1935 | Krick | 2/132 |
| 2,099,356 | A * | 11/1937 | Von Daeniken | 2/93 |
| 2,163,333 | A * | 6/1939 | Von Daniken | 2/255 |
| 2,319,135 | A | 5/1943 | Kaplan | |
| 2,372,752 | A | 4/1945 | Vaccarella | |
| 2,454,076 | A | 11/1948 | Marx et al. | |
| 2,494,185 | A | 1/1950 | Magney | |
| 2,564,008 | A | 8/1951 | Holt | |
| 2,615,167 | A | 10/1952 | Sarff | |
| 2,639,436 | A | 5/1953 | Gavrilovich | |
| 2,651,782 | A | 9/1953 | Oulouhojian | |
| 2,654,889 | A * | 10/1953 | Doric | 2/132 |
| 2,659,892 | A | 11/1953 | Sharp et al. | |
| 2,697,834 | A | 12/1954 | Robinson | |
| 2,719,979 | A * | 10/1955 | Rezek | 2/132 |
| 2,735,104 | A | 2/1956 | Finan | |
| 2,740,125 | A | 4/1956 | Spevak | |
| 2,744,255 | A | 5/1956 | Portias | |
| 2,795,795 | A | 6/1957 | Hobbs | |
| 2,799,024 | A | 7/1957 | Oscard | |

(Continued)

FOREIGN PATENT DOCUMENTS

| | | |
|---|---|---|
| DE | 206831 C | 2/1909 |

*Primary Examiner* — Amber Anderson

(74) *Attorney, Agent, or Firm* — Wood, Herron & Evans, LLP

(57) ABSTRACT

An extendable collar stay that is substantially flat and adjustable to different lengths depending on the size and shape of the collar with which it is used. The extendable collar stay comprises an elongated body that is configured to fit into a collar pocket, with extensions at either end that can be extended to different lengths.

20 Claims, 5 Drawing Sheets

(56) References Cited

U.S. PATENT DOCUMENTS

| | | | | |
|---|---|---|---|---|
| 2,899,681 | A | 8/1959 | Oscard | |
| 2,936,461 | A * | 5/1960 | Robinson | 2/132 |
| 2,992,434 | A | 7/1961 | Weeks | |
| 3,039,112 | A * | 6/1962 | Sucher | 2/132 |
| 3,075,202 | A | 1/1963 | Rubio | |
| 3,129,435 | A * | 4/1964 | Spence | 2/257 |
| 4,064,874 | A * | 12/1977 | Valin | 602/26 |
| 4,118,803 | A | 10/1978 | Blau | |
| 4,975,983 | A | 12/1990 | Everett | |
| 6,089,422 | A | 7/2000 | Gibson | |
| 6,202,221 | B1 * | 3/2001 | Ackley, Jr. | 2/256 |
| 6,526,597 | B1 | 3/2003 | Shepard | |
| 6,748,602 | B1 | 6/2004 | Barnes | |
| 6,889,387 | B1 | 5/2005 | Tiss et al. | |
| D507,205 | S | 7/2005 | Bier et al. | |
| 7,004,361 | B2 | 2/2006 | Thomas | |
| 7,036,696 | B2 | 5/2006 | Lam | |
| 7,392,920 | B2 | 7/2008 | Dedo | |
| 7,409,730 | B2 | 8/2008 | Boos | |
| 7,614,101 | B2 | 11/2009 | Milbourne | |
| D640,042 | S | 6/2011 | Biancamano | |
| 8,220,075 | B2 * | 7/2012 | Chen et al. | 2/132 |
| 2003/0209676 | A1 * | 11/2003 | Loschner et al. | 250/492.2 |
| 2005/0120460 | A1 * | 6/2005 | Friedman | 2/129 |
| 2005/0278826 | A1 | 12/2005 | Kato | |
| 2007/0204374 | A1 | 9/2007 | Bier et al. | |
| 2009/0038049 | A1 | 2/2009 | West | |
| 2009/0144879 | A1 | 6/2009 | Newberry | |
| 2010/0031331 | A1 | 2/2010 | Ichinose et al. | |
| 2010/0088801 | A1 | 4/2010 | Spiros | |
| 2011/0113526 | A1 * | 5/2011 | Harris | 2/132 |
| 2011/0219515 | A1 | 9/2011 | Chen et al. | |

* cited by examiner

EXTENDABLE COLLAR STAY

REFERENCE TO RELATED APPLICATION

The present application claims the benefit of U.S. Provisional Patent Application No. 61/451,112, filed Mar. 9, 2011, whose disclosure is hereby incorporated herein by reference in its entirety.

FIELD OF THE INVENTION

The present invention relates in general to garment accessories, and more specifically to new and useful improvements in shape-retaining collar devices. More particularly, the present invention relates to collar stays that are extendable, shaped to fit into collar pockets, substantially flat and of simple construction.

BACKGROUND OF THE INVENTION

Collar stays (also commonly known as "collar stiffeners," "collar bones," "collar sticks," "collar knuckles," or "collar tabs") are dress shirt accessories. Collar stays are usually smooth, rigid strips of various materials such as metal or plastic, rounded at one end and pointed at the other, inserted into specially made pockets on the underside of a shirt collar to stabilize the collar's points. The primary function of the collar stay is to stiffen the collar of a fabric garment, increasing rigidity and preventing the points (corners) from curling, in order to affect a neater and/or more freshly pressed look. Collar stays also help maintain the spread (distance between the points) of a shirt collar, help prevent the shirt collar from slipping outside of a jacket lapel, and help hide the loop of a necktie.

Historically, stays were sewn, pinned, or inserted into and around collars of men's and women's garments. The advent of plastic in the mid-1920s allowed stays to be more effectively sewn permanently inside of the collar. This continues today, but they can also be permanently fused to the collar fabric or affixed using adhesive. Throughout the mid-20th century, removable stays remained popular, incorporating metal wire and sheet material, often integrating springs and pins. During this period, flat, insertable stays made of plastic were common, sometimes with V- and multi-branched shapes.

Preferably, collar stays should be removable and removed from shirts before dry cleaning or pressing because press-ironing a shirt with the collar stays in place is likely to damage both the shirt and the collar stay, especially if the stay is made of a plastic material that has a tendency to melt. Additionally, pressing a shirt with the collar stays in place results in an impression of the collar stay in the fabric of the collar. Further, it is desirable to have a collar stay that stays in place without the need for pins that pierce and may damage the shirt. Unfortunately, the process of removing the collar stays for cleaning or pressing often results in lost collar stays or collar stays that are mismatched and do not fit the shirt collar. It is therefore also desirable to have an adjustable or extendable collar stay that will fit any shirt collar.

U.S. Pat. No. 2,494,185 discloses an improved shirt collar stiffener of the type adapted to be worn under the turned down portion of the collar and on the point thereof to stretch the cloth and thereby improve the appearance of the collar and to prevent the collar from curling or becoming wrinkled and unkempt. The stiffener of the invention is easily attached or detached and may be varied in length to fit properly under collars of different shapes and depths.

U.S. Pat. No. 2,799,024 discloses a stay to be disposed within the pocket of a collar for maintaining that collar in properly supported condition by engaging with the ends of the stay the base of the pocket and an inner collar zone surface adjacent the conventional line of fold of the collar, said stay including in combination a pair of flexible members in the form of strips disposed in superimposed relationship, means extending from one strip and slidably engaging and overlapping the other strip to maintain those strips in substantial axial alignment, and one of said strips being under tension transversely of its body to draw surfaces of the strips into frictional engagement with each other, said tension being created incident to said one strip being formed of somewhat resilient material and being longitudinally creased intermediate its side edges, the other strip being substantially flat, whereby said strips will resist relative axial shifting.

Accordingly, there remains a need for an improved collar stay that is removable, extendable to fit any size shirt collar, shaped to fit into a collar pocket, relatively flat, simple to manufacture, and that does not containing any pins or sharp ends that may pierce and damage the shirt.

SUMMARY OF THE INVENTION

It is an object of the invention to provide an extendable, preferably removable, collar stay that is simple to manufacture.

It is another object of the invention to provide an extendable collar stay for use with garments, and particularly knitted fabric shirts and dress shirts, wherein the extendable collar stay is shaped to fit into a collar pocket.

It is another object of the present invention to provide an extendable collar stay that is substantially flat.

It is another object of the present invention to provide a collar stay that does not contain any pins or sharp ends that may pierce or damage the shirt.

It is another object of the present invention to provide a collar made of plastic or metal, which may be opaque, translucent or transparent.

There have thus been outlined, rather broadly, the more important features of the invention in order that the detailed description thereof that follows may be better understood, and in order that the present contribution to the art may be better appreciated. There are, of course, additional features of the invention that will be described further hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and earned out in various ways. Also, it is to be understood that the phraseology and terminology employed herein are for the purpose of description and should not be regarded as limiting.

As such, those skilled in the art will appreciate that the conception upon which this disclosure is based may be readily utilized as a basis for the designing of other structures, methods and systems for carrying out the several purposes of the present invention. It is important, therefore, that equivalent constructions, insofar as they do not depart from the spirit and scope of the present invention, be included in the present invention.

For a better understanding of the invention, its operating advantages and the aims attained by its uses, references should be had to the accompanying drawings and descriptive matter which illustrate preferred embodiments of the invention.

BRIEF DESCRIPTION OF THE DRAWINGS

Preferred embodiments of the present invention will be set forth in detail with reference to the drawings, in which.

Common reference numerals are used throughout the drawings and detailed description to indicate similar or like elements.

DETAILED DESCRIPTION OF THE PREFERRED EMBODIMENTS

Figure 1:
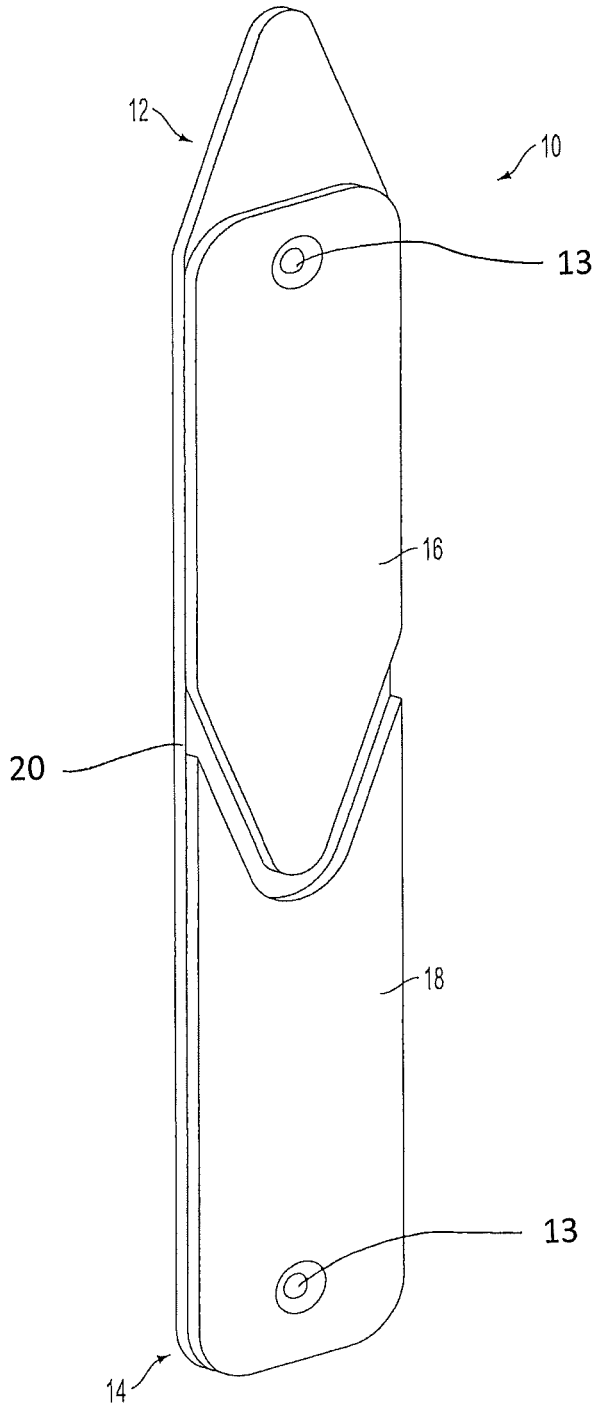
FIG. 1 is a front perspective view of an extendable collar stay according to one embodiment.
Figure 2:
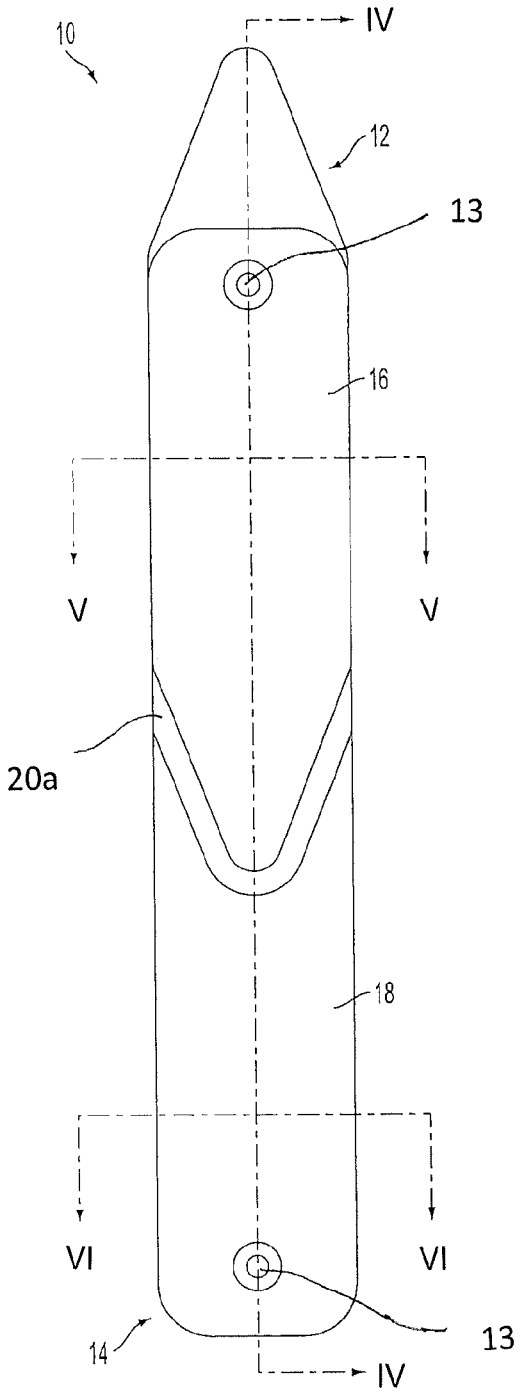
FIG. 2 is a front plan view of the extendable collar stay shown in FIG. 1.
Figure 3:
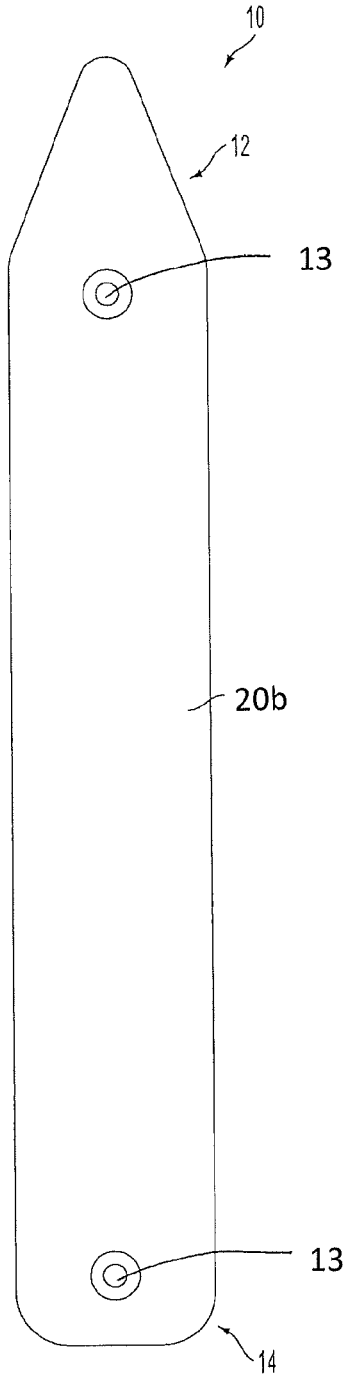
FIG. 3 is a rear plan view of the extendable collar stay shown in FIG. 1.
Figure 4:
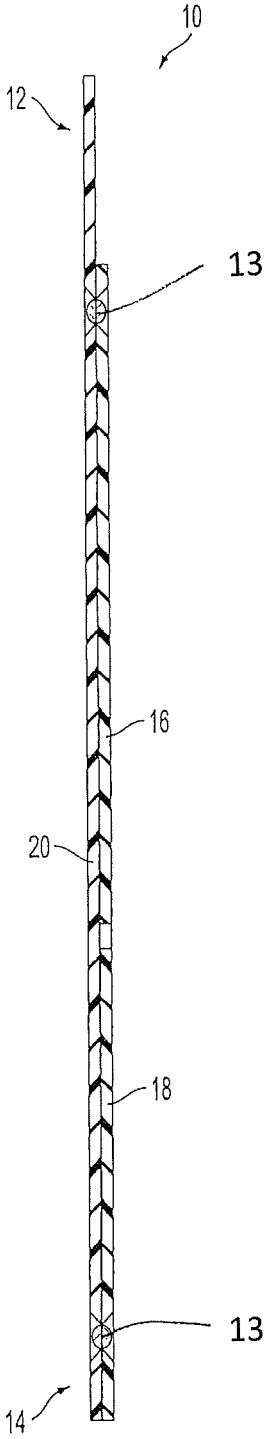
FIG. 4 is a cross section view of the extendable collar stay shown in FIG. 1 taken along line IV-IV.
Figure 5:
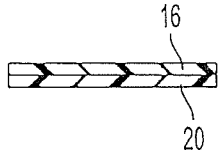
FIG. 5 is a cross section view of the extendable collar stay shown in FIG. 1 taken along line V-V.
Figure 6:
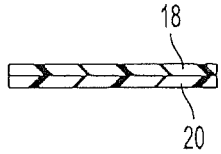
FIG. 6 is a cross section view of the extendable collar stay shown in FIG. 1 taken along line VI-VI.

Referring now to the drawings, which are for illustrating a preferred embodiment of the present invention only, and not for purposes of limiting same, FIGS. 1-7 show an extendable collar stay 10 according to the present invention. As shown in FIGS. 1-7, the collar stay 10 comprises an elongated body 20 which defines a generally planar top surface 20*a*, and an opposed, generally planar bottom surface 20*b*. In the collar stay 10, the body 20 transitions to a first end portion 12, which has a generally tapered configuration forming a tip as seen in the figures. An opposed, second end portion 14 of the body 20 is defined by a laterally extending end surface, which is generally perpendicular to the length of body 20. The transition between the edges of body 20 and the second end portion 14 is preferably generally rounded as shown in the figures. As such, the shape of the collar stay 10 is generally complimentary to the shape of a shirt collar pocket.

The cape of a shirt collar, particularly in the area of the collar points, tends to curl up after laundering. Manufacturing companies may incorporate pockets, liners, and/or patches into the collar structure to prevent the collar from curling up. In certain more expensive shirts, pockets are sewn into the underside of the collar structure to accommodate collar stays. Collar stays may then be inserted into these pockets to stiffen and maintain the shape of the collar and particularly the collar points. Accordingly, according to a preferred embodiment, the first end portion 12 of the collar stay 10 of the present invention is shaped to fit into the collar point of a shirt when inserted into a pocket of a shirt collar, and the second end portion 14 is blunt and adapted to fit against the neckline without discomfort to the wearer.

Figure 7:
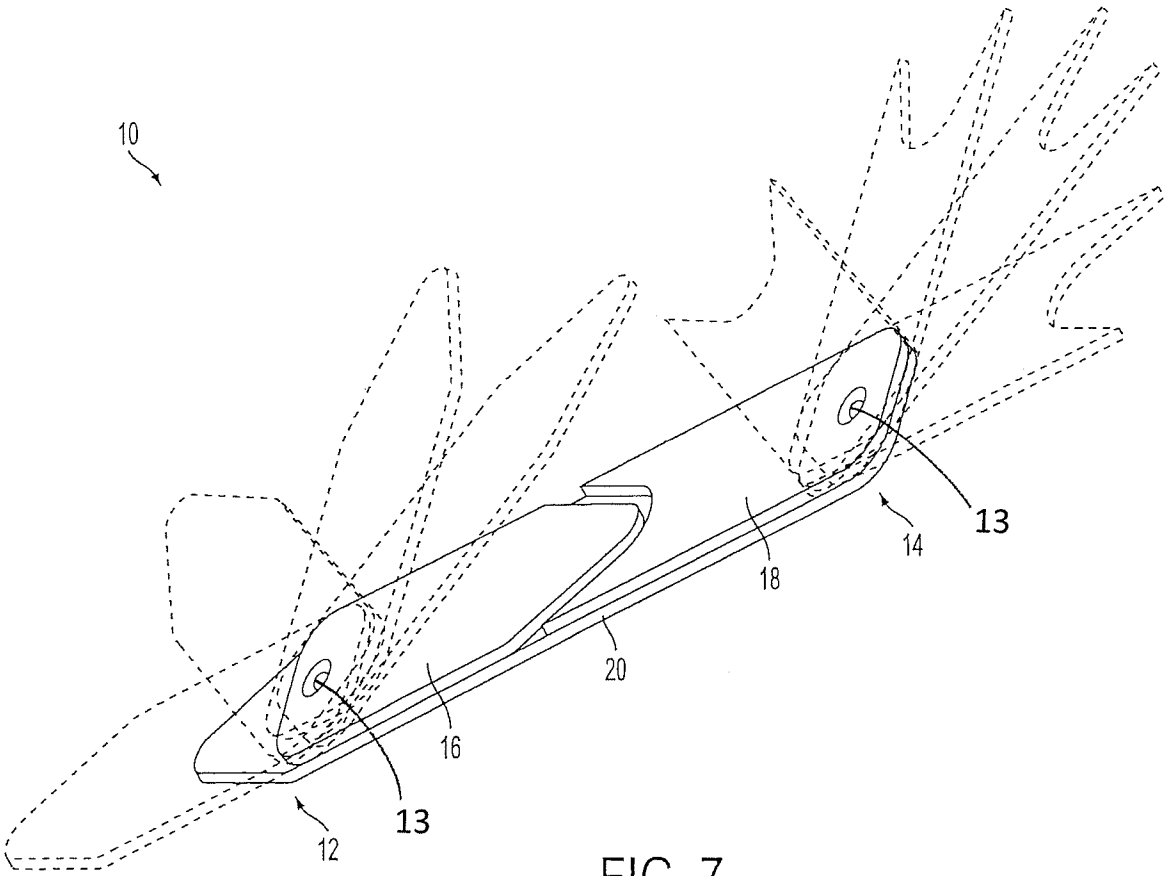
FIG. 7 is a front perspective view of the extendable collar stay shown in FIG. 1 showing alternate positions.
Figure 8:
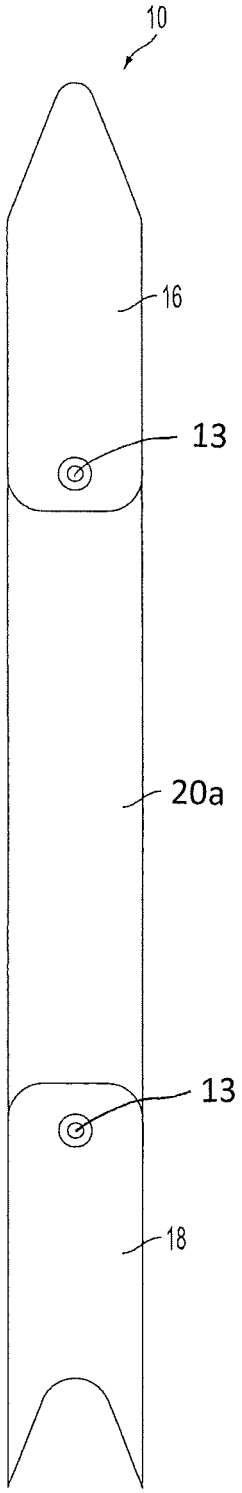
FIG. 8 is a front plan view of the extendable collar stay shown in FIG. 1 showing an alternate position.
Figure 9:
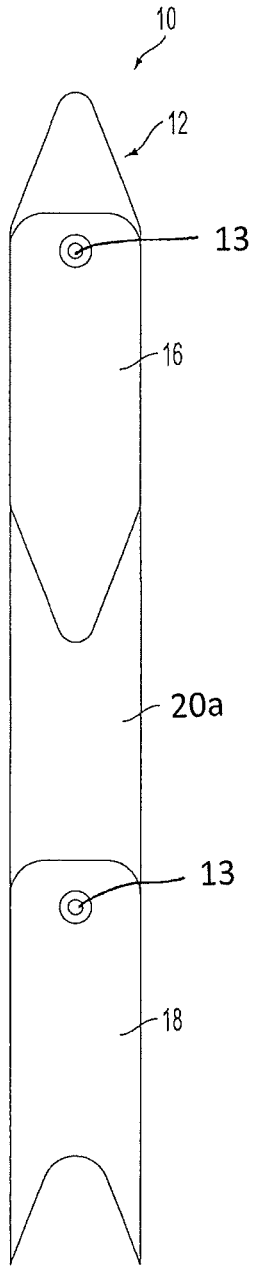
FIG. 9 is a front plan view of the extendable collar stay shown in FIG. 1 showing an alternate position.
Figure 10:
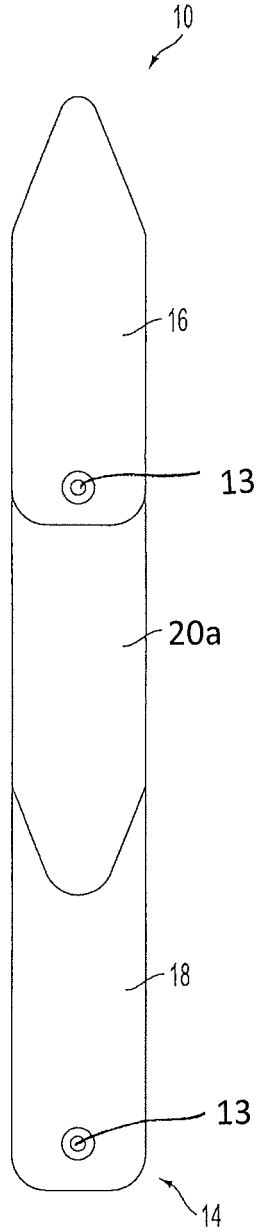
FIG. 10 is a front plan view of the extendable collar stay shown in FIG. 1 showing an alternate position.

As seen in FIG. 1, the body 20 also comprises a head member 16 disposed and spaced generally on top of first end portion 12 and a tail member 18 disposed and spaced generally on the top of second end portion 14. As best seen in FIG. 7, head member 16 and tail member 18 are pivotally connected to first end portion 12 and second end portion 14, respectively, such that the length of the collar stay 10 can be extended to different lengths as shown in FIGS. 8-10.

The head and tail members, 16, 18 are preferably attached to body 20 by a pivot 13 or other suitable means, including but not limited to a rivet, an eyelet, or a pin, that permits the head and tail members, 16, 18 to pivot with respect to body 20 such as to extend the head and/or tail members 16, 18 of the collar stay 10. The head and tail members 16, 18 are accordingly adapted to be extended into different positions as shown in FIGS. 7-10. The pivot 13 is preferably tight so as to hold the head and tail members 16, 18 by friction in any position into which they may be extended. Other means of locking or maintaining the position of the head and tail members 16, 18 of the collar stay are well known to one of skill in the art.

The collar stay shown in FIG. 1 may accordingly be used in alternate positions. As seen in FIG. 8, both the head member 16 and the tail member 18 may be extended such as to provide a long collar stay 10. As seen in FIG. 9, only the tail member 18 may be extended to provide a medium length collar stay 10. As seen in FIG. 10, only the head member may be extend to provide a short collar stay 10. Alternatively, the length of the head and tail members 16, 18 may be varied such that extending the head member 16 and/or the tail member 18 results in a collar stay 10 of varying lengths. Accordingly, the invention is not limited to the configurations shown in FIGS. 8-10, and the lengths of the body 20 and of the head and tail members 16, 18 may be varied such that different lengths may be achieved.

According to a preferred embodiment, the head and tail member 16, 18 are disposed on the top surface 20*a* of the body 20. As a result, the collar stay 10 may be inserted into the complementary pocket of a shirt such that the opposed, generally planar bottom surface 20*b* extends along that side or surface of the shirt collar that would normally be presented for outward appearance, the absence of either the head member 16 or tail member 18 on such bottom surface 20*b* thereby eliminates the appearance of any bumps or surface irregularities on the visible surface of the shirt collar. Along these lines, those of ordinary skill in the art will recognize that the head member 16 and tail member 18 may be positioned on the bottom surface 20*b* rather than the top surface 20*a* without departing from the spirit and scope of the present invention.

The collar stay 10 of the present invention is preferably made of a stiff but flexible material such as plastic or metal material and of a thickness which imparts a suitable level of flexibility thereto, though materials other than plastic and metal are contemplated to be within the spirit and scope of the present invention. By way of example, such materials may include white PVC (polyvinyl chloride) plastic as well as clear polyester, nylon, and PET (polyethylene terephthalate). Stainless steel and brass are also contemplated as well as silver-, gold-, and rhodium-plating; solid silver; gold; copper; nickel; titanium; beryllium; and platinum. The collar stay 10 may also be made of natural materials such as mother of pearl, ivory, bone, and horn, as well as petroleum-based resins.

According to a preferred embodiment, the collar stay 10 of the present invention is preferably between about 0.4 mm to about 0.9 mm thick and between about ⅛" and ½" wide, more preferably between about ⅜" and ¼" wide. Further, the collar stay 10 of the present invention is preferably extendable to 2", 2½" and 3". According to another preferred embodiment, the collar stay 10 of the present invention may also be extendable to 2", 2¾" and 3" or any length between 1½" to 4¾". Those of ordinary skill in the art will recognize that the shape of the body 20 of the collar stay 10 as described above is exemplary only and that alternative shapes for the body 10 are contemplated to be within the spirit and scope of the present invention.

According to another preferred embodiment, the collar stay 10 of the present invention may include a company's or manufacturer's name and/or logo marked by hot-stamping and pad-printing in various colors in the case of a plastic material or engraved by laser in the case of a metal material. Alternatively, the collar stay 10 may also be customized to include monograms, names, special dates, or sayings.

In operation, the typical collar stay 10 is located in a cooperating pocket (not shown). The removable collar stay 10 is formed such that it can be received by the pocket. In such a construction, the collar stay 10 is inserted in the cooperating pocket to extend from the neckline, or in proximity of the neckline, toward the tip of the collar to maintain an unwrinkled and unbent appearance.

Having now described a few embodiments of the invention, it should be apparent to those skilled in the art that the foregoing is merely illustrative and not limiting, having been presented by way of example only. Numerous modifications and other embodiments are within the scope of the invention and any equivalent thereto. It can be appreciated that variations to the present invention would be readily apparent to those skilled in the art, and the present invention is intended to include those alternatives.

Further, since numerous modifications will readily occur to those skilled in the art, it is not desired to limit the invention to the exact construction and operation illustrated and described, and accordingly, all suitable modifications and equivalents may be resorted to as falling within the scope of the invention.

What is claimed is:

1. An extendable collar stay for use with a garment having a collar and a pocket formed on the collar, the collar stay comprising:

an elongated body having an upper surface and an opposing lower surface, the elongated body defining a size and shape complementary to the pocket so as to be insertable within the pocket and so as to define a first end portion with a tip and a second end portion distal from the first end portion;

a head member pivotally connected to the upper surface of the first end portion of the elongated body and configured to pivot to a position such that the head member extends beyond a length of the elongated body to thereby extend a length of the collar stay; and a tail member pivotally connected to the upper surface of the second end portion of the elongated body and configured to pivot to a position such that the tail member extends beyond the length of the elongated body to thereby extend the length of the collar stay;

wherein the head member and the tail member are pivotally connected to the elongated body so that a length of the collar stay can be adjusted by pivoting either or both of the head member and the tail member, and wherein at least one of the head member and the tail member is pivotable to a position that extends a length of the collar stay by at least ½ inch.

2. The collar stay of claim 1, wherein the collar stay is substantially flat.

3. The collar stay of claim 1, wherein the collar stay comprises a flexible material selected from the group consisting of plastic and metal.

4. The collar stay of claim 1, wherein the head member and the tail member are dimensioned and shaped such that, when the head member and the tail member are pivoted to minimize the length of the collar stay, the head member and the tail member do not extend beyond the elongated body.

5. The collar stay of claim 4, wherein the head member and the tail member have end portions that have complementary shapes to engage each other when the head member and the tail member are pivoted to minimize the length of the collar stay.

6. The collar stay of claim 1, wherein the elongated body, the head member and the tail member are each substantially flat.

7. The collar stay of claim 1, wherein each of the elongated body and the head member has a generally tapered configuration forming a tip.

8. The collar stay of claim 1, wherein the collar stay is configured to fit into the collar pocket without piercing the garment.

9. A method for stiffening a collar in a garment, the collar having a pocket formed on the collar, the method comprising:

configuring a length of an extendable collar stay, the collar stay comprising an elongated body having an upper surface and an opposing lower surface, the elongated body defining a size and shape complementary to the pocket so as to be insertable within the pocket and so as to define a first end portion with a tip and a second end portion distal from the first end portion; a head member pivotally connected to the upper surface of the first end portion of the elongated body and configured to pivot to a position such that the head member extends beyond a length of the elongated body to thereby extend a length of the collar stay; and a tail member pivotally connected to the upper surface of the second end portion of the elongated body and configured to pivot to a position such that the tail member extends beyond the length of the elongated body to thereby extend the length of the collar stay; and inserting the collar stay into the pocket, wherein inserting the collar stay into the pocket includes inserting the collar stay into the pocket without piercing the garment.

10. The method of claim 9, further comprising adjusting a length of the collar stay by pivoting either or both of the head member and the tail member in accordance with a depth of the pocket.

11. The method of claim 10, wherein the head member and the tail member are dimensioned and shaped such that, when the head member and the tail member are pivoted to minimize the length of the collar stay, the head member and the tail member do not extend beyond the elongated body.

12. The method of claim 11, wherein the head member and the tail member have end portions that have complementary shapes to engage each other when the head member and the tail member are pivoted to minimize the length of the collar stay.

13. The method of claim 10, wherein adjusting the length of the collar stay includes pivoting at least one of the head member and the tail member to a position that extends a length of the collar stay by at least ½ inch.

14. The method of claim 9, wherein the collar stay is substantially flat.

15. The method of claim 9, wherein the collar stay comprises a flexible material selected from the group consisting of plastic and metal.

16. The method of claim 9, wherein the elongated body, the head member and the tail member are each substantially flat.

17. The method of claim 9, wherein each of the elongated body and the head member has a generally tapered configuration forming a tip.

18. A method for stiffening a collar in a garment, the collar having a pocket formed on the collar, the method comprising:

configuring a length of an extendable collar stay, the collar stay comprising an elongated body having an upper surface and an opposing lower surface, the elongated body defining a size and shape complementary to the pocket so as to be insertable within the pocket and so as to define a first end portion with a tip and a second end portion distal from the first end portion; a head member pivotally connected to the upper surface of the first end portion of the elongated body and configured to pivot to a position such that the head member extends beyond a length of the elongated body to thereby extend a length of the collar stay; and a tail member pivotally connected to the upper surface of the second end portion of the elongated body and configured to pivot to a position such that the tail member extends beyond the length of the elongated body to thereby extend the length of the collar stay;

adjusting a length of the collar stay by pivoting either or both of the head member and the tail member in accordance with a depth of the pocket, wherein adjusting the length of the collar stay includes pivoting at least one of the head member and the tail member to a position that extends a length of the collar stay by at least ½ inch; and inserting the collar stay into the pocket.

19. The method of claim 18, wherein the head member and the tail member are dimensioned and shaped such that, when the head member and the tail member are pivoted to minimize the length of the collar stay, the head member and the tail member do not extend beyond the elongated body.

20. The method of claim 18, wherein the head member and the tail member have end portions that have complementary shapes to engage each other when the head member and the tail member are pivoted to minimize the length of the collar stay.

* * * * *